United States Patent [19]

Wienhold

[11] 4,067,430

[45] Jan. 10, 1978

[54] TYPEWRITER CARRIAGE MOVEMENT MECHANISM

[75] Inventor: James L. Wienhold, Minnetonka, Minn.

[73] Assignee: CPT Corporation, Hopkins, Minn.

[21] Appl. No.: 664,981

[22] Filed: Mar. 8, 1976

[51] Int. Cl.[2] ..... B41J 19/30

[52] U.S. Cl. ..... 197/82; 197/19; 197/176

[58] Field of Search ..... 197/18–20, 197/82, 84 R, 84 A, 84 B, 91, 176–179, 60, 66; 178/34; 340/172.5

[56] References Cited

U.S. PATENT DOCUMENTS

| | | | |
|---|---|---|---|
| 2,700,447 | 1/1955 | Blodgett | 197/20 |
| 3,534,847 | 10/1970 | Willcox | 197/82 X |
| 3,750,797 | 8/1973 | Hunt et al. | 197/176 |
| 3,859,638 | 1/1975 | Hume | 340/173 R |
| 3,927,395 | 12/1975 | Kashio | 197/177 X |

OTHER PUBLICATIONS

Magnetoresistor Differential Sensor FP210, "Siemens Electronic Components Bulletin," VIII, 1973, No. 2, pp. 53–56.

*Primary Examiner*—Paul T. Sewell

*Attorney, Agent, or Firm*—Schroeder, Siegfried, Ryan, Vidas & Steffey

[57] ABSTRACT

There is disclosed a typewriter carriage control mechanism which is used with a single element print head which is constructed and arranged for transverse movement across the typewriter in which a ratchet wheel is connected to the regular spring for moving the carriage in a first direction and having a sensor disclosed in ratchet wheel tooth confronting relationship which provides signals representative of radial movement of the ratchet wheel in which the wheel rotational movement is controlled by pawl devices which is actuated by a pair of solenoids to control the forward movement of the carriage. The backspacing movement of the carriage is controlled through another solenoid mechanism and each of the solenoids are controlled through the use of electronic circuits which receive data information representative of the printing function and the functions of spacing, carrier return, line return, tab, back space, and a nonescapement and correction feature operation. The structure includes a random access memory mechanism for remembering the position of the tab stops and includes counters for counting the movement of the carriage with respect to the left margin. Timing devices are used in the circuits for controlling the elapsed time in which operational functions are incapable of being performed while other functions are being performed.

18 Claims, 15 Drawing Figures

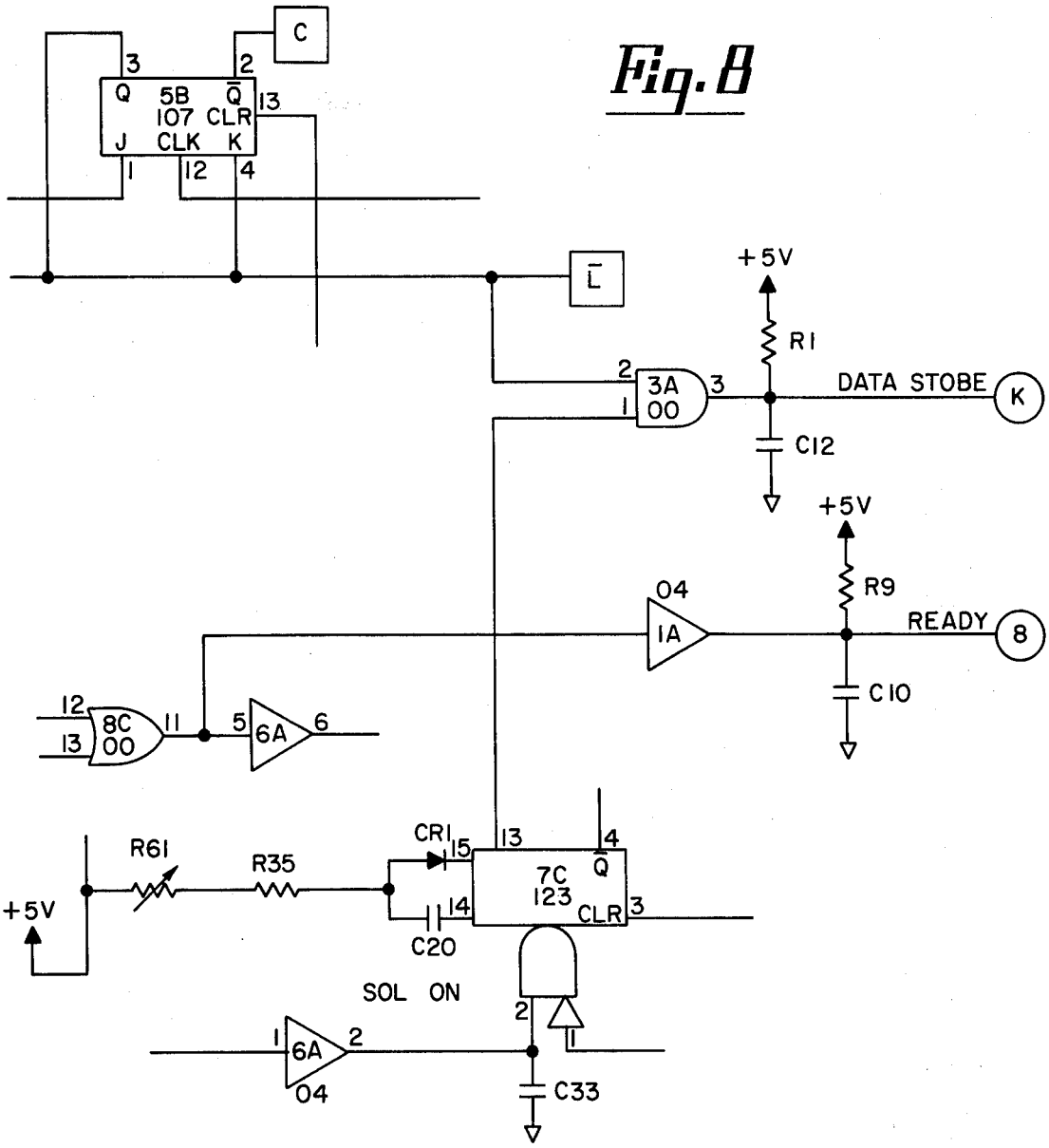
Fig. 8
Fig. 10
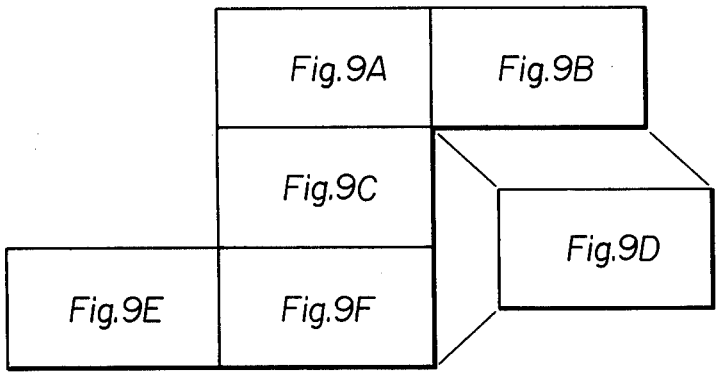

SPACE
CR. RETURN
L. RETURN
TAB
CHARACTER PRINT
DATA 3
DATA 2
DATA 5
DATA 1
DATA 7
BACK SPACE
EUROPEAN TYPEWRITERS OR CONSOLES
TYPEWRITER CKT BOARD
DATA 6
NON ESC
READY
DATA STROBE IN
CORRECT
398
396
+5V
R3
R2
C1
R1
R41
TAB OR CARRIER RETURN
CHARACTER OR SPACE
PRINT
2D 74
2E 74
2A 00
2C 00
1D 01
1D 10
1E 27
2B 04
G
H
I
J
K
L
F
E
D
C
B
A

R̄
Ū
S̄
V̄
T̄
W̄
X
W
V
U
T
R
S
Q
3D 02
+5V
R24
R25
R20
C9
R19
C21
3B 02
04
4E
C10
4B 123
2-5 (μS)
2 Ø CLOCK TIMER
1E 27
BACK SPACE
3E 74
3C,191
H̄
Ī
J̄
K̄
Y
Z
Ā
B̄
C̄
D̄
F̄
Ē
Ḡ

TYPEWRITER CARRIAGE MOVEMENT MECHANISM

GENERAL DESCRIPTION

This invention relates to the field of typewriters and more particularly to the use of an electronic counting and sensing mechanism for controlling the carriage movement of the typewriter.

The present invention is particularly adapted for typewriters of the type including a spherical print head or ball having two degrees of control, that is both tilt of the ball and rotation of the ball. Typewriters which are sold by International Business Machines Corporation designated as Selectric or Selectric II are of the type just mentioned and for additional operating features of such a typewriter, reference may be had to U.S. Pat. Nos. 2,919,002 and 3,233,715.

Typewriters such as those just described have been modified to include desirable characteristics and features for controlling both the print and operational functions of the typewriter and reference may be had to U.S. Pat. No. 3,924,722 entitled "Typewriter With Electronic Keyborad", the patent being assigned to CPT Corporation, Minneapolis, Minnesota.

It is generally recognized that where a mechanical system is used for controlling the carriage movement, the majority of the adjustments required to keep the carriage operating properly form a substantial portion of the overall adjustments that are required to be made to the typewriter. For instance, the carriage movement mechanism of the typewriter such as enumerated above includes the escape mechanism, the tab system, the back space mechanism, carriage return, character print, and in some typewriters such as that disclosed in U.S. Pat. No. 3,924,722, a line return mechanism. In fact, the service manual for the Selectric typewriter, reprinted February, 1972 covering both the Selectric and Selectric II models, include some 150 pages or more directed to operation and adjustments of which, almost half deal with some part of the carriage movement.

With the above in mind, the present invention is directed to a means of electrically controlling the carriage movement so that it may be advanced in predetermined increments in traversing in either direction across the copy medium in increments which are changeable between one-tenth and one-twelvth of an inch. Mechanically, the carriage is moved in one direction by the mainspring of the typewriter which is controlled by a pair of solenoid operated pawls working in combination with at least one toothed wheel. In other words, through the use of the tooth wheel and solenoid operated pawls, the operational functions of spacing, carrier return, line return, tabulation, character print, back space, and a correction operation are controlled through this mechanism with appropriate electronic counters and sensing devices, all of which have a degree of reliability far exceeding the numerous mechanical adjustments which are required to keep the typewriter in constant optimum operation. The present invention makes use of an electronic system which eliminates the vulnerable mechanical elements that are inherently troublesome in the Selectric machines and those using the features of the Selectric.

With the foregoing in mind, it was also desirable to limit modifications of the structure shown in U.S. Pat. No. 3,924,722 primarily through the keyboard buffer circuits and the operational and printing elements of the typewriter.

Upon eliminating those portions of the tabulation mechanism including the rack and set elements, it has been determined that an auxiliary source of stored power shall be incorporated which provides electronic tabulation stops for a period of at least 60 days, the power source being rechargeable when the typewriter is used in its normal operating mode.

The indexing function shall be accomplished in substantially the same manner as described in U.S. Pat. No. 3,924,722 except that the 29 tooth ratchet mechanism will be actuated by a solenoid.

An additional feature of the present invention includes controlling the tab settings through the use of a switch which may be used to "Set" the tab function and "clear" the tabulation setting. The tab stops are so oriented in the electronic circuit that regardless of the position of the left-hand margin, the tab stops will move relative to any change in the left-hand margin setting. That is, the tab settings or stops retain their relative position with respect to the left margin even though the left margin may be varied.

The present invention contemplates eliminating a number of parts from the standard Selectric typewriter such as the escapement rack and pawl which would include either a single or double pitch rack, the filter shaft and the back space rack and its associated pawl, latch assembly and cam and cam follower. In addition, the spacer cam and cam follower along with its latch assembly and interlock and interposer assembly is also eliminated as well as the tab set and clear mechanism working with the tab rack, stops, torque bar and clear bracket. The parts just enumerated are illustrative of those which are eliminated and do not necessarily represent each and every part which is eliminated. The invention also contemplates the elimination of certain parts or replacement parts and some circuits found in U.S. Pat. No. 3,924,722. For instance, as shown in FIGS. 12 and 20E thereof, the space solenoid 11, back space solenoid 12, and carrier return solenoid 13 are disconnected from the circuit as well as the interposer mechanisms shown in FIGS. 1 and 11. In addition, the tab mechanism shown in FIGS. 15 and 16 are also eliminated from the driving circuits in FIG. 20E of U.S. Pat. No. 3,924,722. The indexing mechanism such as shown in FIG. 17 of U.S. Pat. No. 3,924,722 has its cam and cam follower, latch assembly, and operational mechanism removed, the indexing mechanism being controlled by a separate solenoid operated from a new circuit to be described. Other mechanisms such as the interlock switch which was used to control the print circuit during the line return and carrier return, as well as the appropriate switching shown in FIG. 20J of U.S. Pat. No. 3,924,722 have been eliminated from the circuit.

The present invention makes use of the data signals arriving at the second keyboard buffer of U.S. Pat. No. 3,924,722, the signals appearing on FIG. 20B. In addition, a sensor is used to determine the relative position of the carriage with respect to its left-hand margin and this is accomplished through the use of a pair of up and down four bit binary counters to supply signals representative of the carriage position to the circuit. As long as the sensor produces signals representative of movement of the carriage, the counters will continue to determine the relative position of the carriage assembly. Additionally, the circuit will receive input signals prohibiting certain print functions when an operational function is in progress. Through the use of the toothed wheel, both the sensing function of the relative position of the carriage and the control thereof is accomplished through the use of a single mechanism.

In other words, the present invention involves the use of an electronic circuit along with its sensing mechanisms and mechanical mechanisms in a somewhat parallel circuit to control the carriage mechanism for its various modes of operation.

It is therefore a general object of this invention to provide an improved carriage mechanism for a single print head typewriter.

It is still another object of this invention to provide an electronic control mechanism for controlling the position of the carriage mechanism of a single print head typewriter.

It is still a further object of this invention to provide a sensing mechanism for sensing the relative position of the carriage mechanism with respect to the left-hand margin of the typewriter.

It is still another object of this invention to provide a means of positively moving a typewriter carriage assembly both forwardly and backwardly.

It is still another object of this invention to provide a dual pitch typewriter using a toothed wheel and sensor for supplying signals to an electronic circuit for the control of the typewriter carriage assembly.

It is yet another object of this invention to provide a tab memory mechanism which is retained electronically within the control circuits for controlling the carriage mechanism.

It is still a further object of the present invention to provide power means for maintaining electronic tab stops for a predetermined period of time.

It is a further object of this invention to provide interlock timers to permit the appropriate function to take place and then permit resumption of the next desired function to be accomplished.

These and other objects and advantages of the invention will more fully appear from the following description, made in connection with the accompanying drawings, wherein like reference characters refer to the same or similar parts throughout the several views, and in which:

FIG. 8 is an electrical schematic of an interconnection circuit providing input signals to a carriage movement control circuit;

FIGS. 9A through 9F are electrical schematics of the carriage movement and control circuits; and FIG. 10 is a guide to be used with FIGS. 9A through 9F with respect to the inputs and outputs of the circuit.

MECHANICAL MECHANISMS

Figure 1:
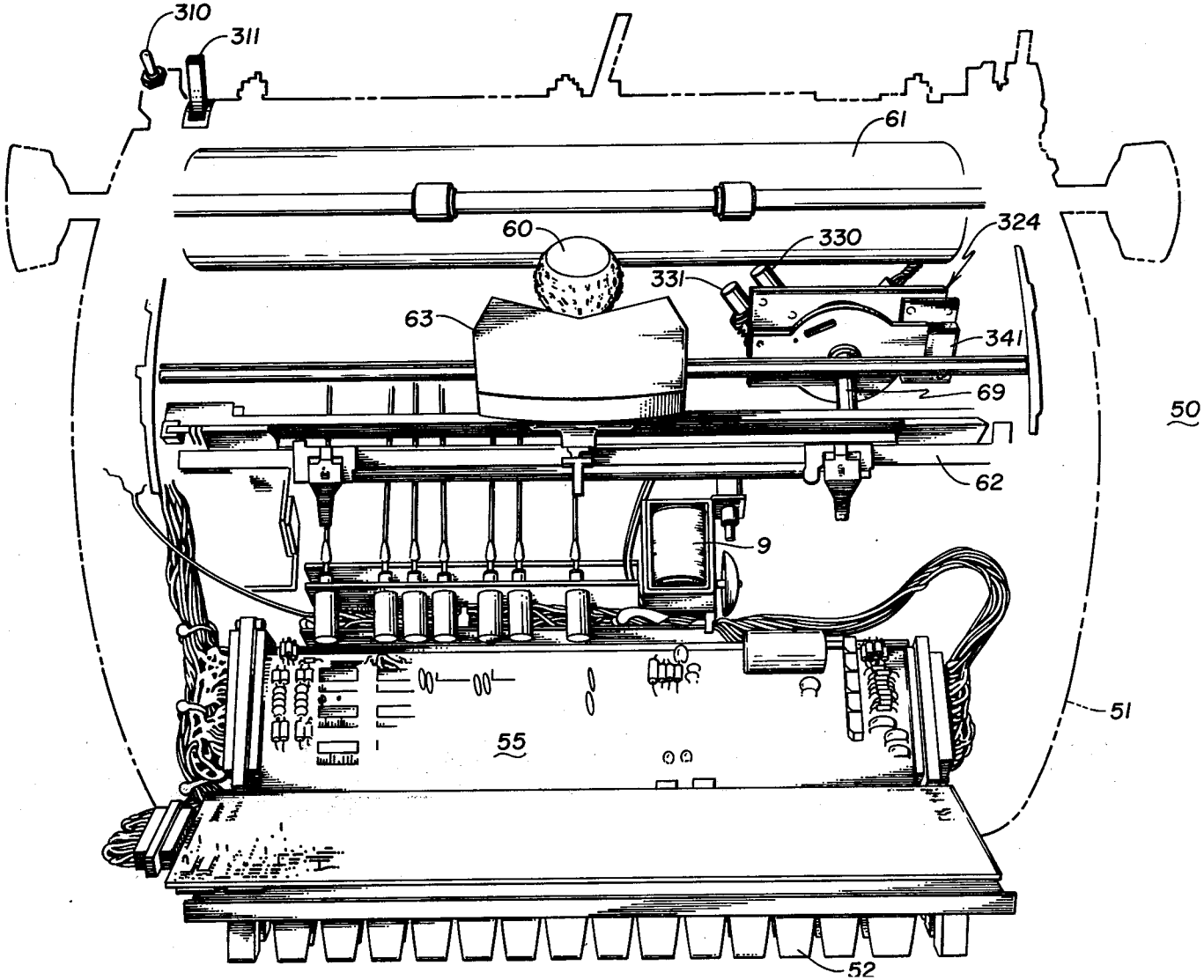
FIG. 1 is a perspective view of the invention as seen from above disclosing the general placement of the parts in the typewriter.

FIG. 1 discloses a typewriter of the type referred to previously as the IBM Selectric with the cover removed and with the invention incorporated as described generally. To further aid in the disclosure of the invention, like reference numerals will be used where the same mechanism is involved as that disclosed in U.S. Pat. No. 3,924,722. The typewriter is shown with a base plate 51 having a keyboard 52 hinged thereto and open to disclose the inner portion of the typewriter. The electronic mechanism is contained generally on a circuit board 55 which will generally contain the electrical elements found in FIGS. 9A–9F of this disclosure as well as the electrical components found in FIGS. 20*b*, 20*c* and 20*d* of U.S. Pat. No. 3,924,722. By comparison to U.S. Pat. No. 3,924,722, it will be seen that the space solenoid 11, the back space solenoid 12, and carrier return solenoid 13 and the index solenoid 14 have been removed with their associated hardware, although solenoid 14 is used in a different mechanism and is shown principally in FIG. 6. Additionally, a line return solenoid 9 is used with much abbreviated mechanism as used in U.S. Pat. No. 3,924,722, and is shown generally in FIG. 7 herein. A single element printer 60 cooperates with a platen 61 of the typewriter over which the paper or printing medium is advanced vertically as the typewriter is operated. A carriage 63 is shown generally carrying the printer 60 and traverses across the paper to perform the printing function. A margin rack 62 is also shown set out in the general location of the operational elements of the typewriter.

A tab switch 310 is located on the upper left-rear portion of the typewriter and is a double pole-single pole center off type switch in which pushing the switch clears the tab settings and pulling the switch toward the operator sets the tab settings. Switch 310 is electrically found in the schematic on FIG. 9E. A pitch lever 311 is located adjacent switch 310 and as will be disclosed later, in its rearward position will operate the typewriter with a space pitch of 10 spaces to the inch and when pulled forwardly towards the operator will operate with 12 spaces to the inch of carriage movement.

Figure 2:
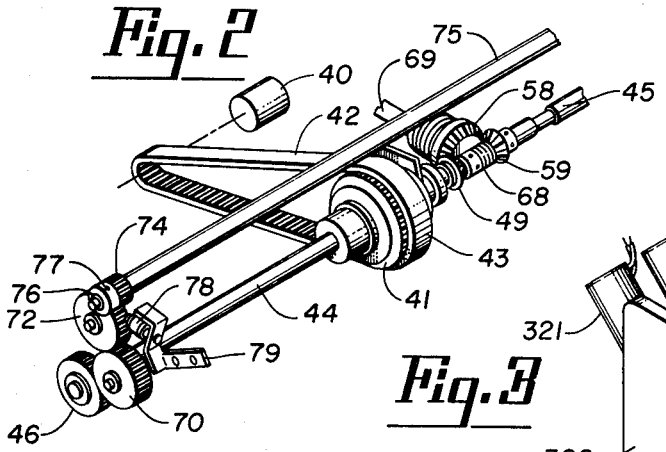
FIG. 2 is a perspective view of the drive train of the invention.

While the escapement rack of the typewriter in using the present invention is not needed, it may be retained as a support for the rear of the carrier (not shown). Turning now to FIG. 2, a motor 40 of the typewriter is connected to a clutch 41 through a drive belt 42 and a pulley 43. Clutch 41 is connected to a cycle shaft 44 which is driven when a proper coupling is made through the clutch. An operational cam shaft 45 is connected to the other side of pulley 43 to provide a means of rotational power for certain operational functions, it being understood that the camming fuction for controlling certain operations of the typewriter has been removed pursuant to the present invention. At the end of shaft 44 is a spur gear 46 which in turn drives two additional spur gears, 70 and 72. Normally, the filter shaft is also driven by spur gear 70 but this also is eliminated in the present invention. Idler gear 70 drives spur gear 72 and another spur gear 74 which is connected thereto. Spur gear 74 is connected to a print shaft 75 and the gear ratio between the other gears and gear 74 is such that gear 74 and print shaft 75 make two revolutions for each revolution of the clutch shaft. An aluminum sleeve 76 is secured to an extension of shaft 75 and contains a magnet 77 inserted in the aluminum sleeve. A coil 78 is held in close proximity to sleeve 76 through the use of a bracket 79 which is secured to the framework of the typewriter. For a further explanation of the timing coil 78, reference may be had to U.S. Pat. No. 3,924,722. Generally speaking, as the magnet passes the end of coil 78 and excites the coil, a positive going and negative going pulse from each pole of the magnet is created and the signal from the coil is amplified and the positive or negative going pulse used as the "closed loop" output. The electrical circuit using a timing coil 78 is shown in FIG. 9B.

A carrier return pinion 49 is secured to operational shaft 45 through a spring mechanism which in turn is secured to clutch 41. The carrier return pinion 49 works with what is generally as known as an escapement cord drum gear 58 that engages a tab pinion gear 59 which is controlled through a tab governor assembly 68. The escapement drum gear 58 is secured to an escapement shaft 69.

Figure 3:
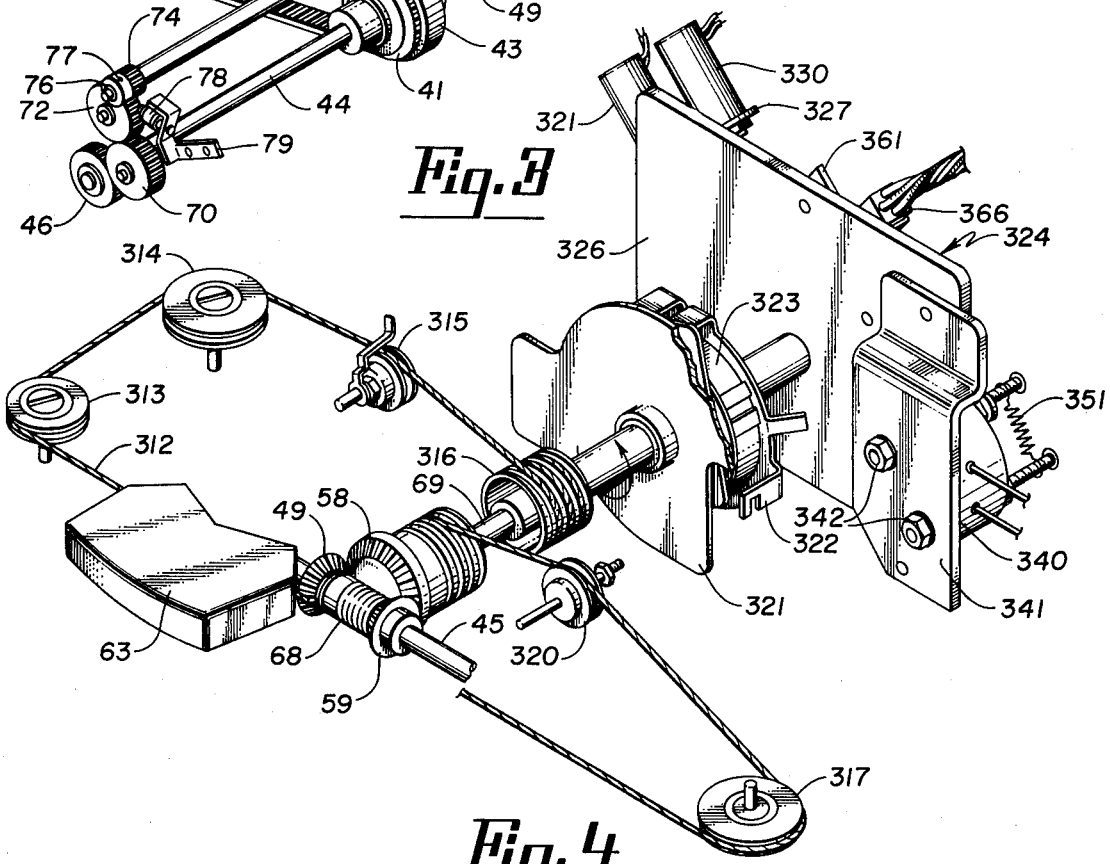
FIG. 3 is a perspective view of the carriage movement assembly.

As best seen in FIG. 3, the carrier or carriage 63 is moved laterally across the typewriter through the use of a cord 312 which is secured to the left-hand portion of carrier 63 and passes around a pair of pulleys 313 and 314 which have their rotational shafts vertically oriented. Cord 313 passes over a guide pulley 315 and then is wound around a carrier return-back space cable drum 316. Drum 316 is also secured to escapement shaft 69. The right-hand portion of carrier 63 has cable 312 connected thereto which passes around another pulley 317 which has its axis vertically oriented and the cable 312 then passes over another guide pulley 320 which has its axis horizontally oriented. The cable is then secured about escapement cable drum 58. Shaft 69 is supported by a bearing (not shown) which is secured to a back plate 321 which has a mainspring housing 322 secured thereto which houses a mainspring 323 that is secured between the housing and shaft 69 to provide spring motive power to escapement shaft 69. That portion of the typewriter just described, relating to the carrier or carriage movement assembly, is old in Selectric model typewriters.

A ratchet assembly 324 is secured to base plate 51 by suitable means such as machine screws and has a ratchet wheel 325 secured to escapement shaft 69 by suitable means such as a coupling 326 formed as part of the ratchet wheel. A plate member 328 forms the main vertical mounting mechanism for a right angle bracket 327 secured thereto with screws 329. Bracket 327 has an escape solenoid 330 and a restore solenoid 331 secured thereto. An escapement pawl 332 is pivotally secured to bracket 327 by suitable means such as a machine screw 333. A dog 334 is formed on the end of escapement pawl 332 to engage teeth 328 of ratchet wheel 325. A tension spring 335 is secured to the other end of escapement pawl 332 on one end and is secured to the right angle portion of bracket 327 on the other end. Solenoid 330 has its plunger secured to escapement pawl 332 by suitable means such as a pin 336 located intermediate dog 334 and pivot 333. Restore solenoid 331 has its plunger secured to pawl 332 by suitable means such as a pin 337 disposed intermediate pivot 333 and the location of spring 335.

Assembly screws 329 may be loosened and bracket 327 moved or rotated to provide the proper clearance and engagement of dog 334 with teeth 328.

A rotary back space solenoid 340 is secured to a mounting bracket 341 through suitable means such as threaded studs which are secured by nuts 342 on the back side of mounting bracket 341. Bracket 341 is secured to vertical plate 326 through suitable means such as a pair of machine screws 343, with the upper screw passing through a slot 344 in plate 326 to provide a pivotal movement about the lower screw for adjustment of the back space solenoid with respect to ratchet wheel 325. Rotary solenoid 340 includes a disc 345 which is rotated approximately 25 degrees and in so doing, carries with it a pawl 346 which is pivotally secured to disc 345 through a machine screw 347. A dog 350 is formed on the end of pawl 346 and is located adjacent teeth 328 of ratchet wheel 325 for engagement therewith. A spring 351 is secured to the other end of pawl 346 and is anchored under tension to disc 345 by suitable means such as a machine screw 352. A cam 353 is fixedly secured to disc 345 by a screw 354 and is held in engagement with pawl 346. Through the movement of cam 353, the "throw" of the pawl may be controlled as dog 350 engages teeth 328. One such suitable back space solenoid is that manufactured by Ledex, part No. H-2650-028.

A magnetoresistor differential sensor 360 is secured to a sensor block 361 by suitable means such as a set screw 362. Sensor block 361 is secured to plate 326 through suitable means such as machine screws 363 which ride in a pair of slots 364 and 365 formed in sensor block 361 to provide means for adjustment of sensor 360 in proximity with teeth 328. Sensor 360 has a three terminal network which is electrically connected through a plug 366. Sensor 360 may be off the type manufactured by Siemens of Germany, Part No. FT210L100 which is also disclosed in a document entitled Magnetoresistor Differential Sensor FT210 and is a reprint front "Siemens Electronic Components Bulletin" VIII (1973) No. 2, pages 53 to 56 by Ulrich Von Borcke. The electrical characteristics of the sensor will be described in more detail in the operation of the circuit for which it supplies signals. Ratchet wheel 325 which works in cooperation with sensor 360, has 29 teeth when providing a pitch of ten spaces to the inch and uses 35 teeth when providing 12 spaces to the inch for the carriage assembly.

Figure 4:
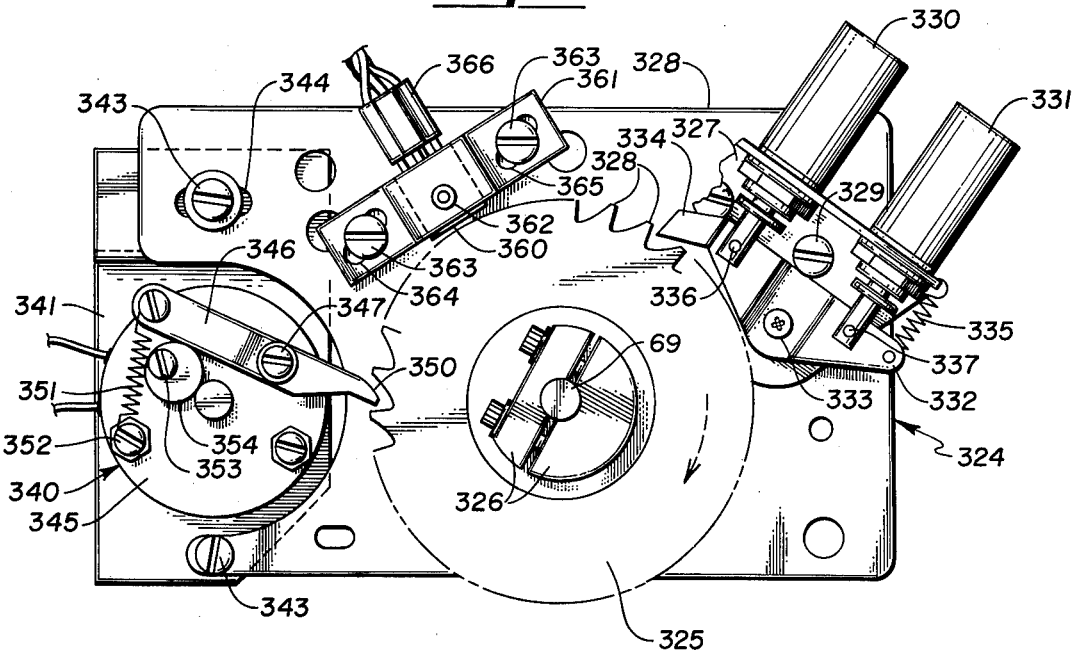
FIG. 4 is an elevation view of the ratchet and escapement assembly used to move the carriage in a forward and reverse direction.
Figure 5:
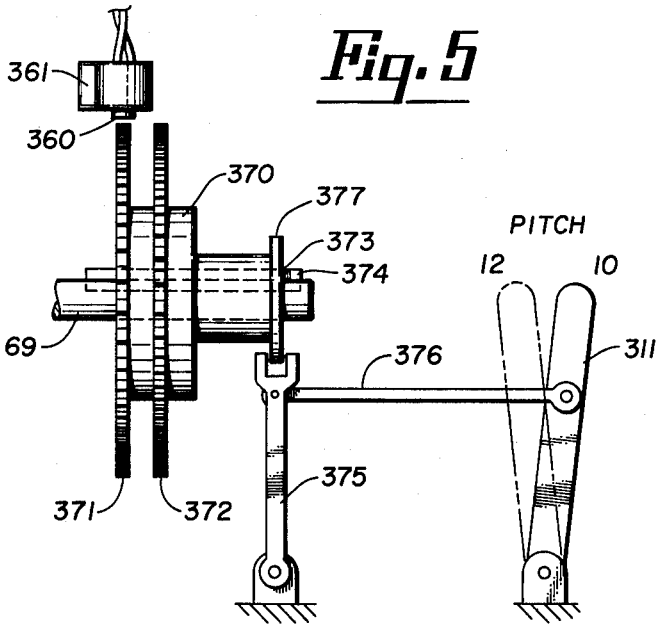
FIG. 5 is a diagrammatic view of the ratchet assembly having a double pitch.

Because it may be desirable to have either 10 or 12 pitch capabilities within the typewriter, reference is not made to FIG. 5 in which a modification of ratchet wheel 325 is shown. A ratchet wheel 370 is shown in which there are two toothed wheels 371 and 372 which have 29 teeth and 35 teeth respectively to provide a 10 pitch movement and a twelve pitch movement. Ratchet wheel 370 is secured against rotation on shaft 69 through the use of a keyway 373 and a key 374 which is secured to shaft 69 in an axial slot thus permitting the hub of ratchet wheel 370 to move axially along shaft 69. This is accomplished through pitch lever 311 moving a forked arm 375 through a connecting link 376. The forked portion of arm 375 engages a collar 377 to provide the axial movement just described. It will be noted that ratchet wheels 371 and 372 have the same diameter and thus provide the same gap with respect to sensor 360 in determining the position of each of the teeth with respect to sensor 360. Similarly, the two pawls and their respective dogs 334 and 350 have no problem in actuating either of the toothed wheels 371 or 372 when used in place of ratchet wheel 325 as disclosed in FIG. 4.

Figure 7:
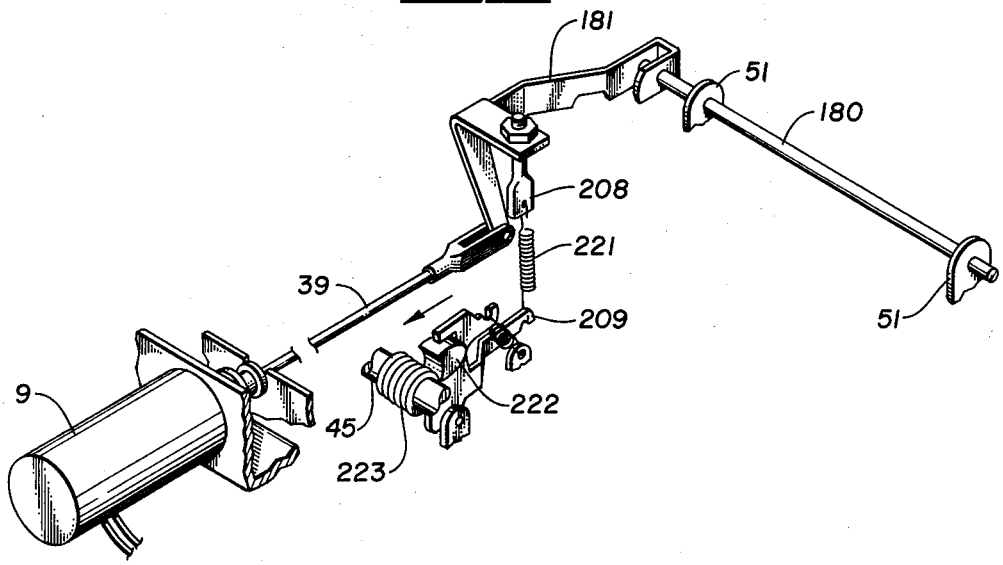
FIG. 7 is a perspective view of the line return mechanism.

U.S. Pat. No. 3,924,722 made use of a line return feature which permitted the carriage to return to the left margin without indexing the platen and hence provided a difference from a carrier return function which not only returned the carrier to the left edge of the margin but also advanced or indexed the platen. FIG. 7 discloses that relevant portion of the line return mechanism in which a shaft 180 is connected to a line return arm 181 through suitable means such as set screws. Line return solenoid 9 is connected to the lower end of line return arm 181 through a connecting link 39. An actuating arm stud 208 is connected to line return arm 181 at a square shank portion and is connected to a clutch actuating arm 209 through a tension spring 221. Actuating arm 209 carries a shoe 222 which overlies the clutch spring 223 to drive the carrier return pinion gear 49. Thus a rotation of shaft 180 and the movement of return arm 181 initiates the motion of the carrier return pinion gear 49 to produce the line return movement of carriage 63.

As explained earlier, the indexing mechanism of the normal Selectric typewriter as disclosed in U.S. Pat. No. 3,924,722 (see FIG. 17 therein) has been removed, keeping in mind that link 219 does in fact control the pawl mechanism of the platen for indexing thereof.

Figure 6:
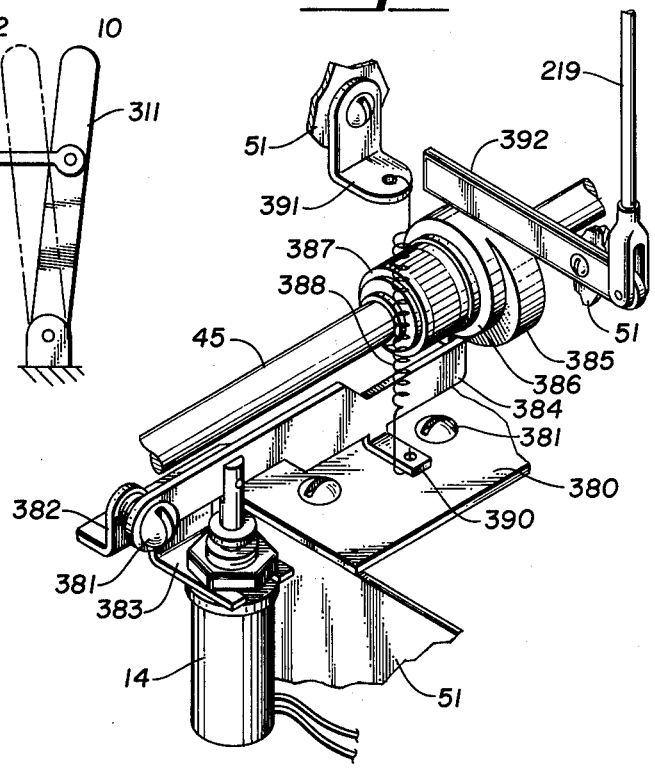
FIG. 6 is an isometric view of the index drive mechanism.

In FIG. 6, a bracket 380 is secured to typewriter frame 51 through suitable means such as machine screws 381. Bracket 380 has an upturned portion 382 and a lateral extending portion 383 which supports solenoid 14. A latch member 384 is pivotally secured to upstanding portion 382 of bracket 380 through suitable means such as a machine screw 381. Latch member 384 is disposed vertically opposite shaft 45 and engages a cam member 385 which is secured to a clutch latch member 386. The two members are secured to an index clutch 387 which is connected to shaft 45. One such clutch which has been found to be suitable for this purpose is one manufactured by Helander Products, Clinton, Connecticut, Part No. SP50-1368. A tension spring 388 is secured to a lug 390 formed from latch member 384 and is secured to another lug 391 which is secured to frame member 51 through suitable means such as a machine screw. Thus spring 388 keps latch member 384 in engagement with the lip of latch collar 386 to prevent rotation of cam 385. Upon index solenoid 14 being energized, latch member 384 is withdrawn from the notched portion of collar 386 and cam 385 is permitted to rotate. At the other end of cam follower arm 392, a clevis member is connected to index link 219 and intermediate the two ends of member 392, is a pivot member in the form of a machine screw which is secured to frame member 51. Thus rotation of cam 385 produces the indexing movement in the connecting link 219.

The other mechanical mechanisms which were disclosed in U.S. Pat. No. 3,924,722 remain substantially unchanged in their operation. The operation of the mechanical features of the typewriter incorporating this invention will become more apparent through the relationship with the circuits which are about to be described to drive the solenoids and certain of the mechanical mechanisms just described.

ELECTRICAL MECHANISM

The electrical circuits are described in FIGS. 9A through 9F, the circuits being connected to each other in the manner shown in FIG. 10. Standard symbols are employed in the electrical schematics including such components as inverters, gates, counters, etc. As an aid to simplifying the schematic, which utilizes a number of integrated circuits, reference is had to Signetics Digital 54/7400 Data Book published by the Signetics Corporation of 811 East Arques Avenue, Sunnyvale, California 94086. In addition to the 7400 series integrated series, the circuit also makes use of an up-down 4 bit binary counter which is designated IM-6523 manufactured by Intersil, Inc., 10900 North Tantau Avenue, Cupertino, Calif. 95014. Generally speaking, the 7400 logic family are medium speed TTL and high speed TTL integrated circuits. The family includes the multiple number of functions in a variety of different electrical packages. The following chart includes the type number and description as follows:

| TYPE | DESCRIPTION |
|---|---|
| 7400 | Quadruple 2-Input Positive NAND Gates |
| 7402 | Quadruple 2-Input Positive Nor Gates |
| 7404 | Hex Inverters |
| 7410 | Triple 2-Input Positive NAND Gates |
| 7427 | Triple 3-Input Nor Gates |
| 7474 | Dual D-Type Edge-Triggered Flip-Flop |
| 74123 | Dual Retriggerable Monostable Multivibrators W/Clear |
| 74191 | Up-Down 4 Bit Binary Counter |
| 75451 | Dual Peripheral Driver |
| IM6523 | 256 Bit Random Access Memory |

Reference may be had to U.S. Pat. No. 3,924,722 for a detailed explanation of the operation of the various electronic control circuits for the typewriter but a brief explanation will be made concerning the typewriter operational functions. Upon depressing one of the typical operations keys, a signal was sent to the number 1 keyboard buffer. A gate sensed the data lines prior to reaching the number 1 keyboard buffer and this data was applied to a strobe discriminator which filtered out short noise pulses and permitted only the legitimate key closures to continue through the circuit. A clock pulse was then used to admit data to the number 1 keyboard buffer. Once the data was received in keyboard buffer number 1, it remained there until the next clock pulse was received until power was turned off in the system. If another key were depressed while the typewriter was busy printing, the data was stored in keyboard buffer No. 2 which is connected directly to keyboard buffer No. 1. Any new data entry would be held in buffer No. 1 and as the typewriter continued a printing mode of operation, the code would be moved through the buffer stages. That is, the code is buffer No. 2 moves into buffer No. 3 and the code in buffer No. 1 moves into buffer No. 2. Once the data is received in the keyboard buffers, the keyboard strobe output was pulsed at the input to the solenoid driver circuit as the typewriter makes use of each code, a control counter working in conjunction with each of the buffers, has its code data "substracted" causing the data to step from buffer control counter stage 2 into buffer control counter stage 3 and if data is present in buffer control counter 1, it will then move into buffer control counter 2. This process continues until the counters are empty and until the clock pulses empty the buffers. Thus the counter controls the buffer control lines.

In order to provide a proper data strobe signal, reference is now made to FIG. 8 in which a signal is taken from the "number 3 loaded" counter as shown in FIG. 20G of U.S. Pat. No. 3,924,722. The data strobe signal is obtained from terminal K of the flip-flop of the Dual JK Master-Slave Flip-Flop designated 5B-107, the signal appearing at terminal $\overline{L}$. This signal is applied to a NAND Gate designated 3A-00 where the output signal appears on terminal K.

From FIG. 20I of U.S. Pat. No. 3,924,722, it will be seen that only a single output has been shown from the "Solenoid On" multivibrator and a signal is taken from pin 13 thereof which is applied to the NAND Gate 3A-00. The Solenoid On multivibrator provides the signal at pin 4 thereof to fire the print and operation circuits which are used in the solenoid driving circuit. That same signal appearing on pin 4 also forms an input to the reset interlock multivibrator which supplies a signal to pin 12 of NAND Gate 8C-00 as shown herein on FIG. 8. Another signal is received from the interlock delay bistable latch circuit 9C-75, also shown in FIG. 20I of U.S. Pat. No. 3,924,722. This signal has been designated a "ready" signal and occurs after any delay signal has been completed for functions such as the tabulation functions. The ready signal appears at terminal 8 and both signals, the "data strobe" and "ready" signals are used as inputs to the carrier control circuit.

Figure 9A:
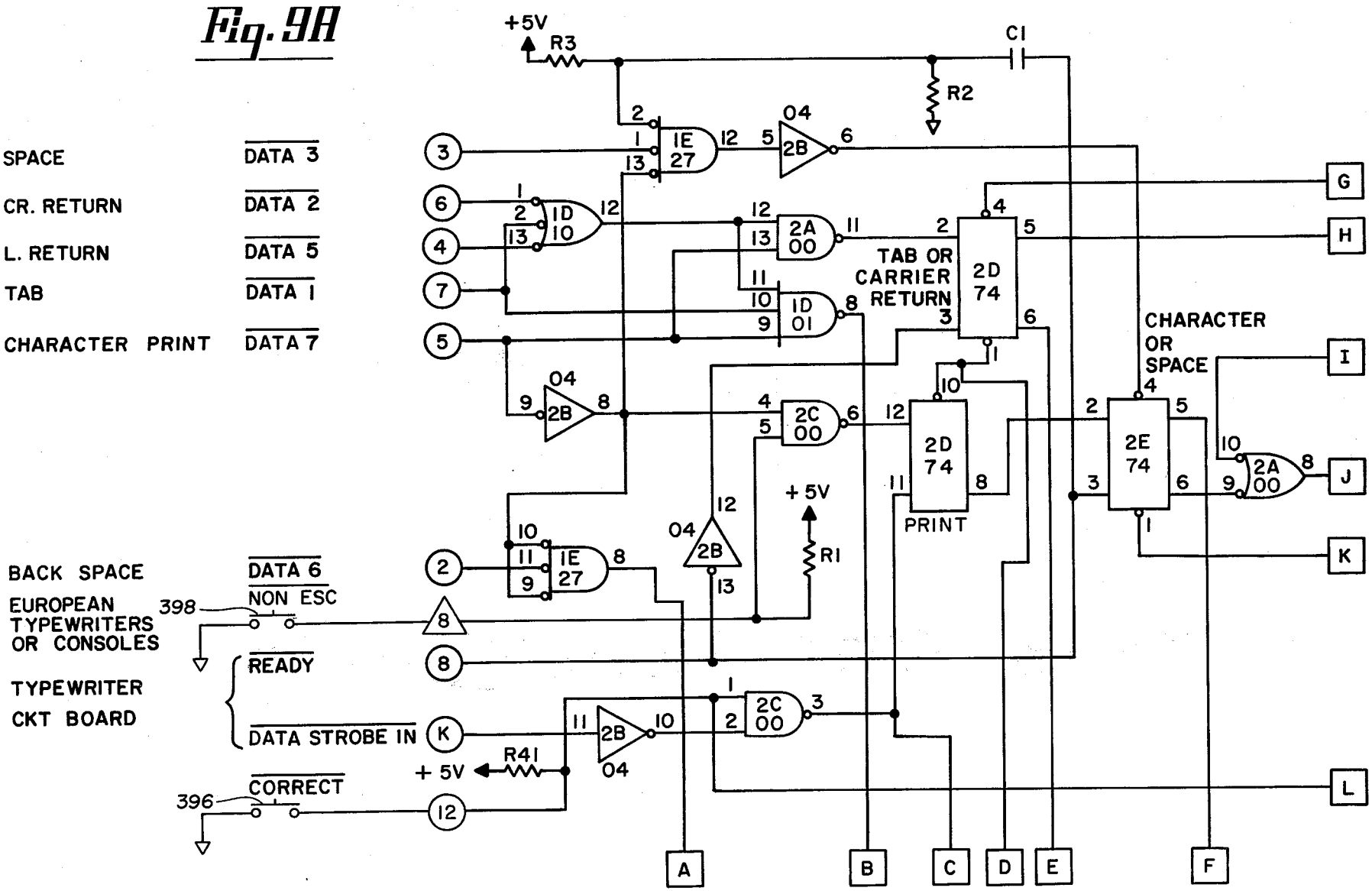
Figure 9B:
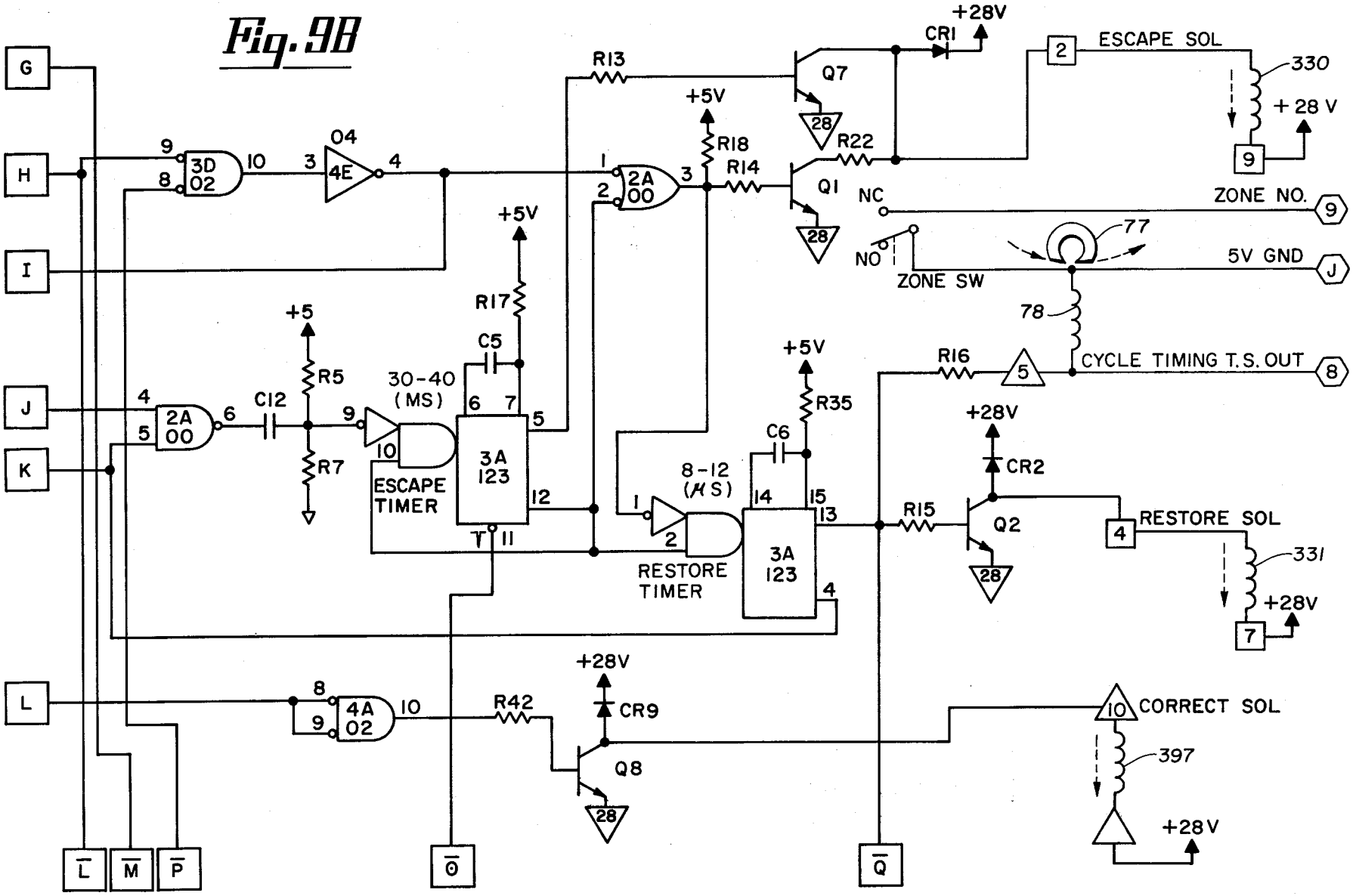
Figure 9C:
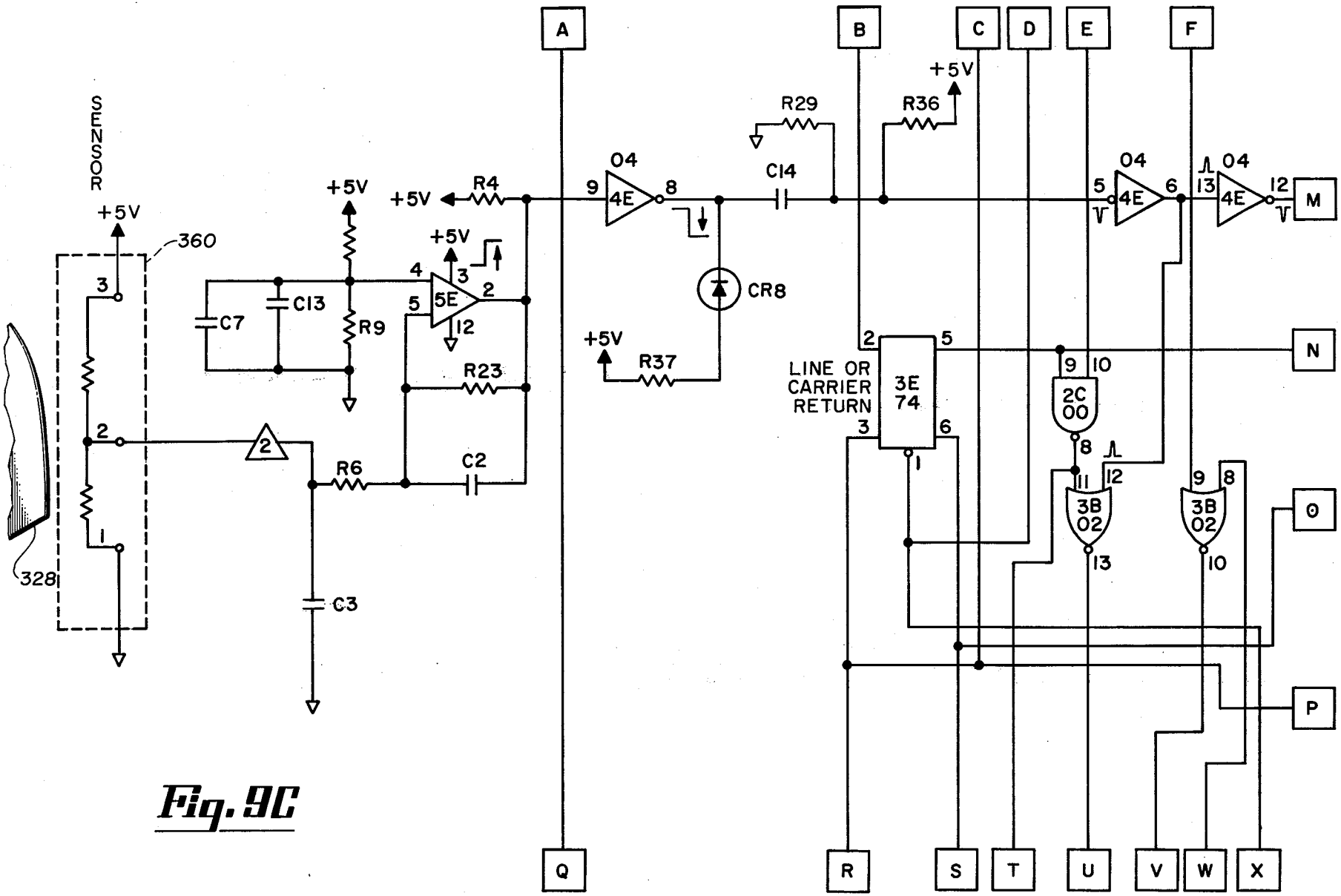
Figure 9B:
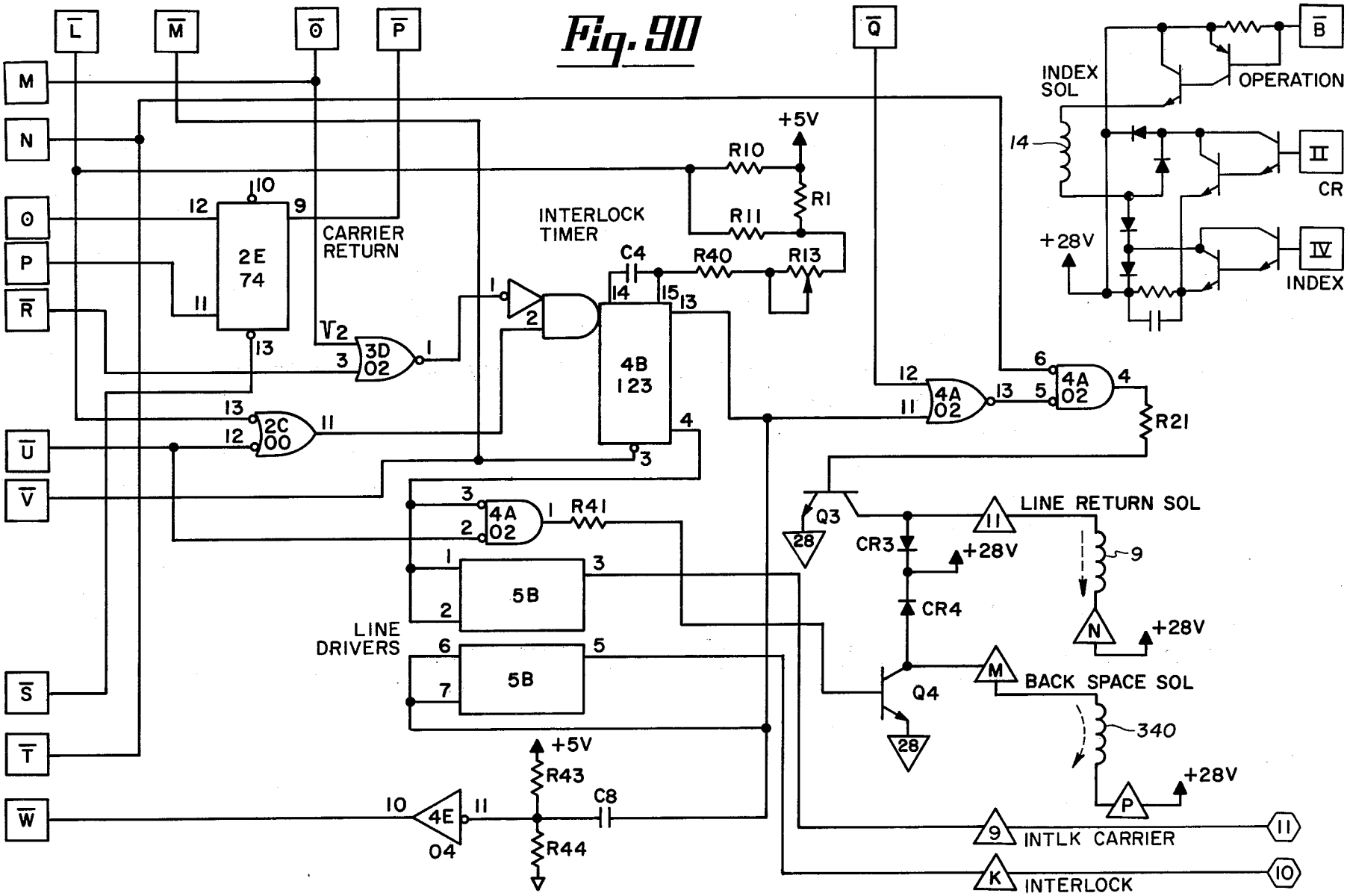

Turning now to FIG. 9A, reference is made to the two signals just described coming from the typewriter circuit board which appear on terminals "8" and "K". Additionally, the data received from the typewriter circuit board disclosed in U.S. Pat. No. 3,924,722 includes data taken from the output of keyboard buffer No. 1 which is shown therein in FIG. 20B. Thus, the data 3 signal for a "space" function is obtained at terminal R1 and applied to terminal 3 of FIG. 9A, the data 2 signal for "carrier return" is obtained from terminal Q1 and applied to terminal 6 in FIG. 9A, the data 5 signal for "line return" is obtained from terminal T1 and applied to terminal 4, the data 1 signal for "tab" is received from terminal P1 and applied to terminal 7 of FIG. 9A, the data 7 signal for "character print" is obtained from terminal X1 and applied to terminal 5 of FIG. 9A, and the data 6 signal for "back space" is obtained from terminal U1 and applied to terminal 2 of FIG. 9A. In addition, a pair of inputs to the circuit are controlled through a pair of switches which ground the inputs to certain of the circuits such as the nonescape signal used with European typewriters or consoles which is applied to terminal No. 8 (shown in a triangle). Another input which is controlled through a switch is a ground applied to the input of the circuit for a "correct" function in which a magazine holding a correcting tape is used where it is desirable not to have the carriage move upon striking the character which was incorrectly struck. The "correct" circuit appears on pin 12 of FIG. 9A.

The function which will occur the majority of the time is the printing of characters such as the alphabet and these are formed from various combinations of the different data input signals. Assuming that a print function is to take place and that escapement must be controlled for the print function, a character print signal will be present on pin 5 along with signals present on the other data signals used to control the different typewriters characters, and a data strobe signal will also be present, thus those data bits will be gated into the print flip-flop 2D-74. It will be noted on the circuit that each of the inverters, gates, latches or any of the other components that the numbers such as 00, 10, 27, 74, etc. are abbreviations for the 7400 family which is listed in the chart and serves to further identify each of the integrated circuit elements. Integrated circuit 2D (pins 8–12) is a flip-flop that stores a print escapement command which is applied to the character or space flip-flop (pins 1–6) upon completion of a typewriter print function. The output of character or space flip-flop 2E-74 is applied through a NAND gate 2A-00 through an escape timer 3A-123 (pins 5–12). The escape timer is fired for escape timer 3A–123 (pins 5–12). The escape timer is fired for every operation which is decoded. As long as a tooth is passing adjacent sensor 360 (FIG. 9C) a signal will be generated from sensor 360 which is applied to pin 11 on the escape timer multivibrator 3A-123. While the escape timer is active, transistor Q7 is energized which permits full voltage to be applied to the escape solenoid 330 (FIG. 9B). The escape timer has a duration of 30–40 milliseconds. Energizing solenoid 330 causes dog 334 to be withdrawn from the space between teeth 328 of ratchet wheel 325 (FIG. 4) thus permitting shaft 69 to start turning clockwise as seen in FIG. 4. Typically the escape timer is cut off after 7–9 milliseconds by a pulse from sensor 360 after a tooth 328 moves past the sensor, at which time the restore timer 3A-123 (pins 4–15) pulses a transistor Q2 which energizes the restore solenoid 331 to ensure a positive resetting of the escapement pawl, and particularly dog 334 against one of the teeth 328. The restore timer also provides an output. The time period of the restore timer is 8 to 12 milliseconds and at the end of this time period, restore solenoid 331 is de-energized. By reference to U.S. Pat. No. 39924,722, it will be determined that a complete printing cycle included approximately 28 to 33 milliseconds "rest time" in addition to the 35 milliseconds "on" time. A timer was provided to produce a 40 millisecond delay time signal, but upon receiving a signal from the cycle timing coil, the "rest" or "delay" time was cancelled upon the printer being ready to receive another input signal. A restore timer 3A-123 (pin 13) also provides an output signal to the timing coil circuitry (pin 8, FIG. 9B) which resets the reset interlock control as shown in FIG. 20I of U.S. Pat. No. 3,924,722.

The ratchet wheel sensor 360 output is applied through resistor R6 to a comparator chip 5E. When sensor 360 detects a ratchet tooth present, a positive going high output is produced at pin 2 which is applied to the input of inverter 4E-04 on pin 9 thus producing a negative going edge of a square wave on the output at pin 8. A light emitting diode (led) CR8 is connected to output line 8 of inverter 4EO4. The other terminal of CR8 is connected to a positive 5 volts DC through a resistor R37. One such diode which has been found to be suitable is type FLV117. The output of inverter 4E-04 is applied to a differentiating network comprising C14, R29, and R36 which produces a negative going spike voltage which is applied to inverter 4E-04 at pin 5, the output on pin 6 is applied to the input of 3B-02 at pin 12 and a negative going spike is applied to the input of NOR gate 3B-02 as well as the escape timer as described earlier. The light emitting diode CR8 is used in setting the relative position of sensor with respect to ratchet wheel 325. There will be one pulse for each tooth of the ratchet wheel that passes sensor 360. The FLV 117 is manufactured by Fairchild Semi Conductor Division of Fairchild Camera and Instrument Corporation, 313 Fairchild Drive, Mountain View, Calif. 94040.

During the space function, a signal is received at terminal 3, FIG. 9A and is applied to the character or space flip-flop 2E-74 in the same manner as a signal for printing of a character. However, in the case of a space operation, flip-flop 2E-74 is preset by a signal appearing on terminal 4 thereof because it is not necessary to wait for the typewriter to print a character before performing the movement of the carriage. Because the escape timer 3A-123 is fired for each operation which is decoded, it is also reset in the same manner as a print operation through a strobe signal on pin 11 from the sensor when the next tooth of the ratchet wheel 325 is detected. Thus the escape timer 3A-123 operates for 7–9 milliseconds to energize escape solenoid 330 and is then cut off by a pulse from sensor 360. After the escape timer is operated, it will be recalled that the restore timer 3A-123 is actuated which energizes the restore solenoid 331. Through the use of the signal applied to the same output coming from the timing coil 78, (pin 8) spacing operations may occur at the rate of 22 to 25 cycles per second. A signal is also applied from character or space flip-flop 2E74 at pin 5 to the input of pin 9 of NOR gate 3B-02.

In the event a data signal for line return is received at input terminal 4, the signal is passed on to tab or carrier return flip-flop 2D-74, it being understood that the data bits are gated with a data strobe signal appearing on terminal K. As will be explained more fully later, upon completion of the line return operation, tab or carrier return flip-flop 2D-74 will be preset through pin 4. A signal from tab or carrier return flip-flop 2D-74 on pin 5 is applied to NOR gate 3D-02 and after passing through an inverter 4E-04, the signal is applied through a pair of NAND gates to escape timer 3A-123. Escape timer 3A-123 actuates transistor Q7 causing escape solenoid 330 to be energized. If the carrier is at the right frame position, sensor 360 will no longer produce a signal and the escape timer will cease operation at the end of 30–40 milliseconds. After the 30–40 millisecond time period, transistor Q7 is cut off and transistor Q1 supplies a reduced power holding circuit through resistor R22 to the escapement solenoid 330.

A signal is also applied to line or carrier return flip-flop 3E-74 which sets the flip-flop. Carrier return flip-flop 2E-74 (pins 8–13) is connected to the line or carrier return flip-flop 3E-74 in the manner of a counter. When the second of consecutive stroke pulses is detected, carrier return flip-flop 2E-74 will produce a high going pulse at pin 9 which produces a low going pulse at pin 8 of NOR gate 3D-02 which then interlocks further activity of the escape or restore solenoid circuitry due to the output signal on NAND gate 2A-00, pin 3. This action then dampens any carrier mechanism oscillation at the left margin of the typewriter during any repeat line return operation.

Timer 4B-123 (pins 1–4, 13–15) is used for multiple purposes, one of which is to provide an interlock command signal to the keyboard buffer control circuit which inhibits further input to the printer during operational functions such as carrier return, line return, and tab operations. This will be more fully explained later. Normal expiration time of interlock timer 4B-123 during a line return operation is 100 milliseconds. As long as sensor 360 is producing pulses, these pulses appear at interlock timer 4B-123 through NOR gate 3D-02 and the timer is then retriggered upon each sensor pulse for another 100 milliseconds. When the sensor output stops, that is when it reaches the end of its travel during a line return operation, interlock timer 4B-123 will expire after 100 milliseconds. Upon interlock timer 4B-123 expiring, interlock command of line drivers 5B-75451 will return to its stand-by state and permit further input to the printer circuit on the keyboard buffer circuit through terminals 10 and 11 as shown in FIG. 9D where those terminals are connected to the circuit of FIG. 20J in U.S. Pat. No. 3,924,722.

Interlock timer 4B-123 has a resistor bridge coupled to pin 15 which provides a means of selecting one of two voltages to be applied to the timer. When the voltage on pin 13 of NAND gate 2C-00 is driven to a low level, the voltage is increased. When pin 5 of tab or carrier return flip-flop 2D-74 is at its low value, interlock timer 4B-123 has a time period of 100 milliseconds during the line return, carrier return, and tab function while a high going pulse produces a time period of 35–45 milliseconds for the back space function.

The interlock timer start command is received at pin 2 from NAND gate 2C-00 which is gated by a signal from tab or carrier return flip-flop 2D-74 (pin 5) whenever pin 5 is at a low voltage value for a tab, carrier return or line return function.

When the line return data input signal appears on terminal 4, after passing through NAND gate 1D-10, pins 13 and 12, the signal also appears as an input signal at NAND gate 1D-01, pin 11, the output being applied as an input signal to line or carrier return 3E-74 at pin 2. The output signal from line or carrier return flip-flop 3E-74 appears as an input to NAND gate 4A-02 and upon interlock timer 4B-123 being fired transistor Q3 is energized and line return solenoid 9 is energized. When interlock timer 4B-123 expires, pin 5 of NAND gate 4A-02 is held low for an additional 8–12 milliseconds through NAND gate 4A-02, pins 12 and 13 from the restore timer 3A-123. The additional time for which the line return solenoid 9 is held energized permits the escapement pawl 332 to settle in the ratchet 325 before the line return clutch 223 is disengaged.

After sensor 360 quits sending pulses to comparator 5E, there is no longer a pulse to escape timer multivibrator 3A-123 and upon expiration of the escape timer, restore timer 3A-123 pulses transistor Q2 which energizes restore solenoid 331 to reset escapement pawl 332. It will also be remembered that the restore timer 3A-123 provides an ouput to the timing coil circuitry which resets a timer on the keyboard buffer circuit, U.S. Pat. No. 3,924,722. Comparator 5E is a voltage comparator which is designed to operate from a single power supply over a wide range of voltages. For a more detailed description of the comparator, reference may be had to a publication dated June, 1973 entitled "Linear Integrated Circuits Catalog" published by National Semi Conductor, 2900 Semi Conductor Drive, Santa Clara, Calif. One such comparator is that designated LM339 which is disclosed on pages 32 through 34 of Section 3.

A carrier return operation or function is much like that of the line return plus actuating the index function. Therefore, upon receiving a data 2 signal for carrier return at input terminal 6, the line return solenoid is energized in the same manner just described for the line return function. At the same time, a carrier return signal is received at terminal II on FIG. 9D which is the same signal that appears on a like terminal of FIG. 20E in U.S. Pat. No. 3,924,722. Upon a simultaneous signal appearing at terminal $\overline{B}$, the operation function is permitted and this signal is also received from a terminal with the same designation in FIG. 20E of U.S. Pat. No. 3,924,722. Thus with the two signals coinciding, and passing through the Darlington drivers, index solenoid 14 is energized to produce the index function as described earlier.

When it is desirable to initiate a tabulation function, a tab signal appears on input terminal 7. As explained earlier, tab or carrier return flip-flop 2D-74 is reset on a tab signal where pin 5 is at a low voltage. Upon completion of the operation, it is preset through pin 4 which will be explained later. Escape timer 3A-123 is fired and escapement solenoid 330 is energized in the manner described previously. During the tab function, upon expiration of the 30–40 milliseconds, transistor Q1 supplies a reduced power holding circuit to escapement solenoid 330 through resistor 22 in the manner described previously.

To keep track of the relative position of the carriage with respect to the carriage frame, a random access memory 4D-6523 (FIG. 9E) is incorporated. The random access memory is controlled through a pair of binary up/down counters 3C-191 and 4C-191. The memory is programmed using the tab set-clear switch 310 with inputs on pins 12 and 13 of the random access memory. When the input count equals the tab set count, the output on pin 6 of 4D-6523 is low. Each time the carriage is returned to the left-hand margin through the function of line return carrier return, counters 3C-191 and 4C-191 are reset to zero through a low going signal to pin 11 of each of the counters which is driven by NOR gate 3B-02, pin 4. Whenever the carrier reaches the left margin stop on the typewriter, counters 3C-191 and 4C-191 will be at zero and NAND gate 1D-10 produces a low going signal on pin 6 which is inverted by coupling pins 2 and 3 of NOR gate 3B-02 and is applied as the reset signal just described previously at the two counters, pins 11. Through the use of the reset signal, the left margin is fixed and the counter cannot count below zero and thus become out of synchronization with the tab stop positions as printed on the typewriter print out medium.

A two phase clock timer 4B-123, (pins 6–12) is used to generate a two phase clock pulse for the tab circuitry. An output signal from two phase clock timer 4B-123 is taken from pin 12 and applied to a differentiating circuit made up of capacitor C11 and resistor R34 and is applied to the input terminal of counter 4C-191 at pin 14. Upon timer 4B-123 expiring in 2–5 microseconds, pin 5 goes to a low value and capacator C9 and resistor R25 differentiates this signal and applies it to NOR gate 1E-27 at pin 4. This signal is in effect, a tab check pulse. Pin 3 of NOR gate 1E-27 will be low during a tab operation which is received from NAND gate 2C-00, pin 8. If the signal at pin 5 of NOR gate 1E-27 is also low, which is received from the random access memory, then the output of NOR gate 1E-27 at pin 6 will go high and pass through NOR gate 3B-02, pins 5 and 4 to act as a preset signal for tab or carrier return flip-flop 2D-74 at pin 4 as explained earlier. The two phase clock timer 4B-123 receives an input at pin 9 only during a tab operation which comes from NOR gate 3B-02, pin 13. Pin 11 thereof will be at a low value in the case of a tab function as a result of the output from NAND gate 2C-00, pin 8. The other input to NOR gate 3B-02, pin 12, will receive positive pulses from inverter 4E-04 which receives its signals from sensor 360. There will be one pulse produced for each tooth 328 of ratchet wheel 325 that passes by sensor 360. Another input two phase clock timer 4B-123 at pin 10, is actuated through a signal arriving by way of differentiating capacitor C21 and resistor R20 upon receiving the signal from NOR gate 3B-02, pin 10. The input to NOR gate 3B-02 at pin 9 is taken from character or space flip-flop 2E-74 at pin 5 which is set during a printing or space operation. During the time interlock timer 4B-123 is interlocking a tab operation, the sensor input at pin 1 retriggers the interlock timer in the same manner as during the line return or carrier return operation described previously. When the tab stop command signal from NAND gate 1E-27, pin 6 occurs, it passes through NOR gate 3B-02, pins 5 and 4 and appears on pin 3 of interlock timer 4B-123 to clear the timer for an immediate input. In other words, there is no waiting for another 100 milliseconds to occur for the timer to expire. As explained earlier, the input to interlock timer 4B-123 is at pin 2 and is gated by NAND gate 2C-00 at pin 13 to start the timer command signal from tab or carrier return flip-flop 2D-74 when pin 5 goes to a low value. Upon expiration of escapement timer 3A-123, the restore timer is again actuated which energizes transistor Q2 to energize restore solenoid 331 and simultaneously provides a timing signal at pin 8 (FIG. 9B) which is applied to terminal 8 of FIG. 20J of U.S. Pat. No. 3,924,722 for control of the keyboard buffer circuits.

A battery 395 (FIG. 9E) is connected to random access memory 4D-6523 to supply voltage thereto so that the position of the tab stops may be retained in the random access memory. In other words, through the use of the voltage applied to the random access memory and setting the tab positions electronically, they are retained in that setting as long as proper voltage is applied to the random access memory. A battery charger circuit is connected in parallel with battery 395. A pair of transistors Q5 and Q6 and their associated circuits function as a charging circuit for the 3.6 volt battery which is connected to random access memory at pin 16. Pin 3 is allowed to float in the high state when the system five volt power is turned off requiring less battery current for this mode of operation. Charging of battery 395 occurs whenever the five volts in the system is turned on.

When a back space function is created, a data signal is received on input terminal 2 is applied to NOR gate 1E-27 at pin 11. This signal is applied to back space flip-flop 3E-74 (pins 8–13) which is set whenever the back space signal is decoded. A high input signal from pin 9 of the back space flip-flop is applied to pins 5 of counters 3C-191 and 4C-191 to cause the counters to count down. The same high going signal is applied to NAND gate 1D-10 (pins 3–6) on pin 3. The other two inputs, on pins 4 and 5 come from the output of counters 3C-191, pin 12, and counter 4C-191 which produce a high going signal whenever the count reaches zero. As stated earlier with respect to movement of the carrier, when back spacing the carrier and it reaches the left margin stop on the typewriter, the counters will be at zero and a low going signal will appear on NAND gate 1D-10 at pin 6 and after being inverted, is applied to NOR gate 3B-102 to hold the counters at zero, thus preventing additional back spaces to be on the left margin.

The back space flip-flop 3E-74 applies a signal on pin 9 to the input of NOR gate 3B-02, pin 8, for each back space operation. The output signal appearing at pin 10 is differentiated and applied to the two phase clock timer 4B-123 as explained previously.

Interlock timer 4B-123 is also used to provide an interlock against printing while the back space function is taking place and a time of 35–45 milliseconds is produced because pin 5 of tab or carrier return flip-flop 2D-74 is in a high state rather than a low state producing the longer time period for the tab function, carrier return function and line return function.

Interlock timer 4B-123 is gated by a signal from NOR gate 3B-02, pin 1 where pin 2 receives the sensor pulses from sensor 360 which are necessary to retrigger interlock timer 4B-123. In addition, pin 3 of NOR gate 3D-02 receives its signal from back space flip-flop 3E-74 which inhibits passae of the sensor pulses during a back space operation. When back space flip-flop 3E-74 is set, it produces an ouptut signal on pin 8 which is applied to NAND gate 2C-00, pin 12 to serve as a start command for interlock timer 4B-123. Upon NAND gate 4A-02 receiving signals from interlock timer 4B-123 and a signal from back space flip-flop 3E-74, pin 8, transistor Q4 will be energized and complete the circuit to energize back space solenoid 340. Once 35–45 milliseconds for the back space function has been completed, interlock timer 4B-123 expires and the circuit is ready for the next functional operation.

One some typewriters where it is desirable to operate a correcting mechanism which carries correcting tape, a provision is made to operate such a mechanism. A Correcr switch 396 is connected to the input of NAND gate 2C-00 at pin 1 and to ground so that the input may be grounded when the "Correct" function is to be employed. The effect is to energize transistor Q8 and energize a correct solenoid 397. Correct solenoid 397 is connected to the mechanical structure for operating the correcting mechanism.

Another imput is provided which is entitled "non-escape" and appears at input terminal 8 in the triangle and this is used generally with European typewriters or consoles in which it is desirable not to advance the carriage while placing a superimposed symbol above the character which has just been typed. The signal is applied to NAND gate 2C-00 at pin 5 to inhibit print flip-flop 2D-74 at pin 12 thereof. Thus there is no signal presented to escape timer 3A-123 and as a result, the escape solenoid 330 is not energized. Such a condition is created buy a non-escape switch 398 which is grounded on one terminal and connected through input terminal 8 (in a triangle) as just described.

Figure 9E:
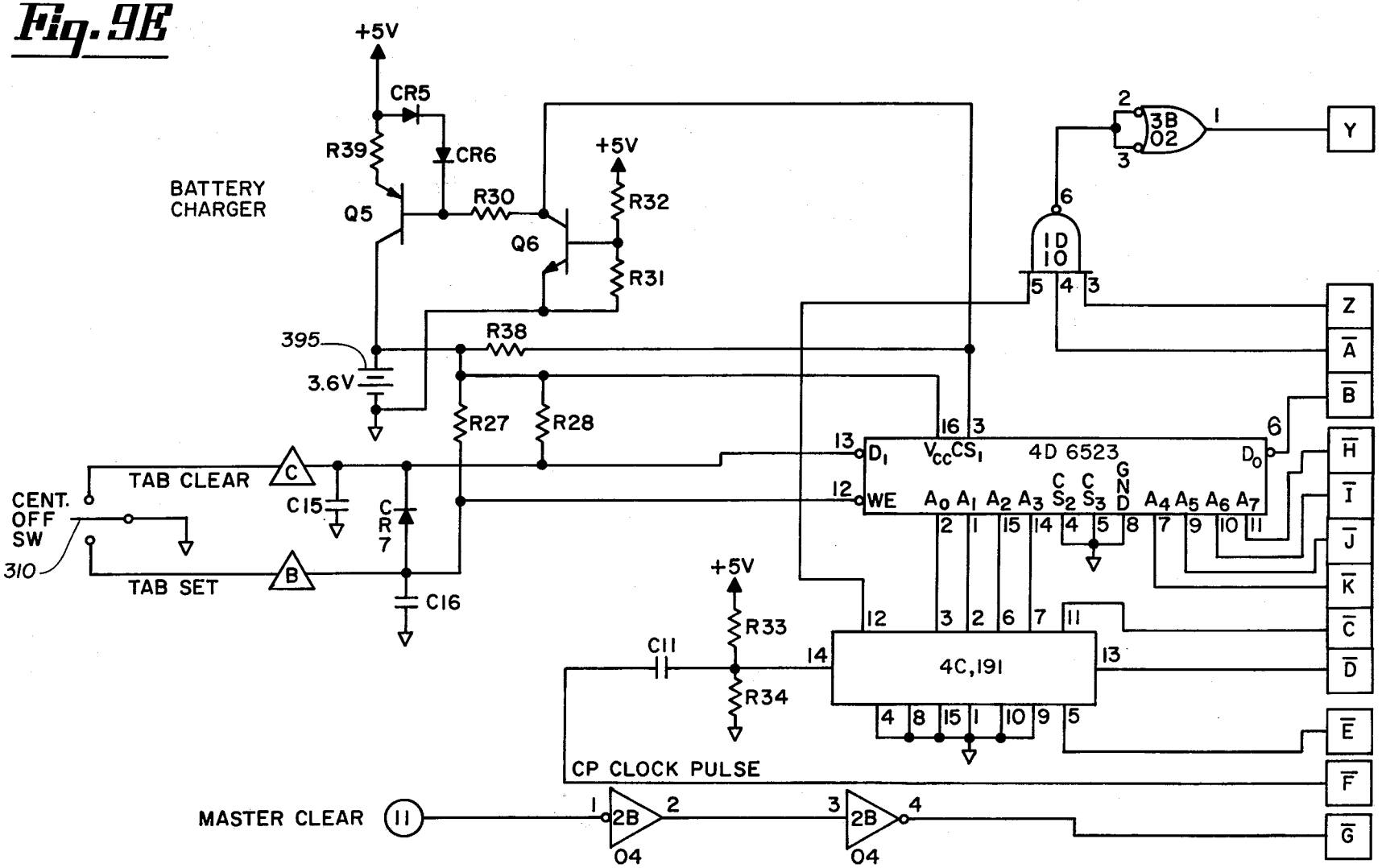
Figure 9F:
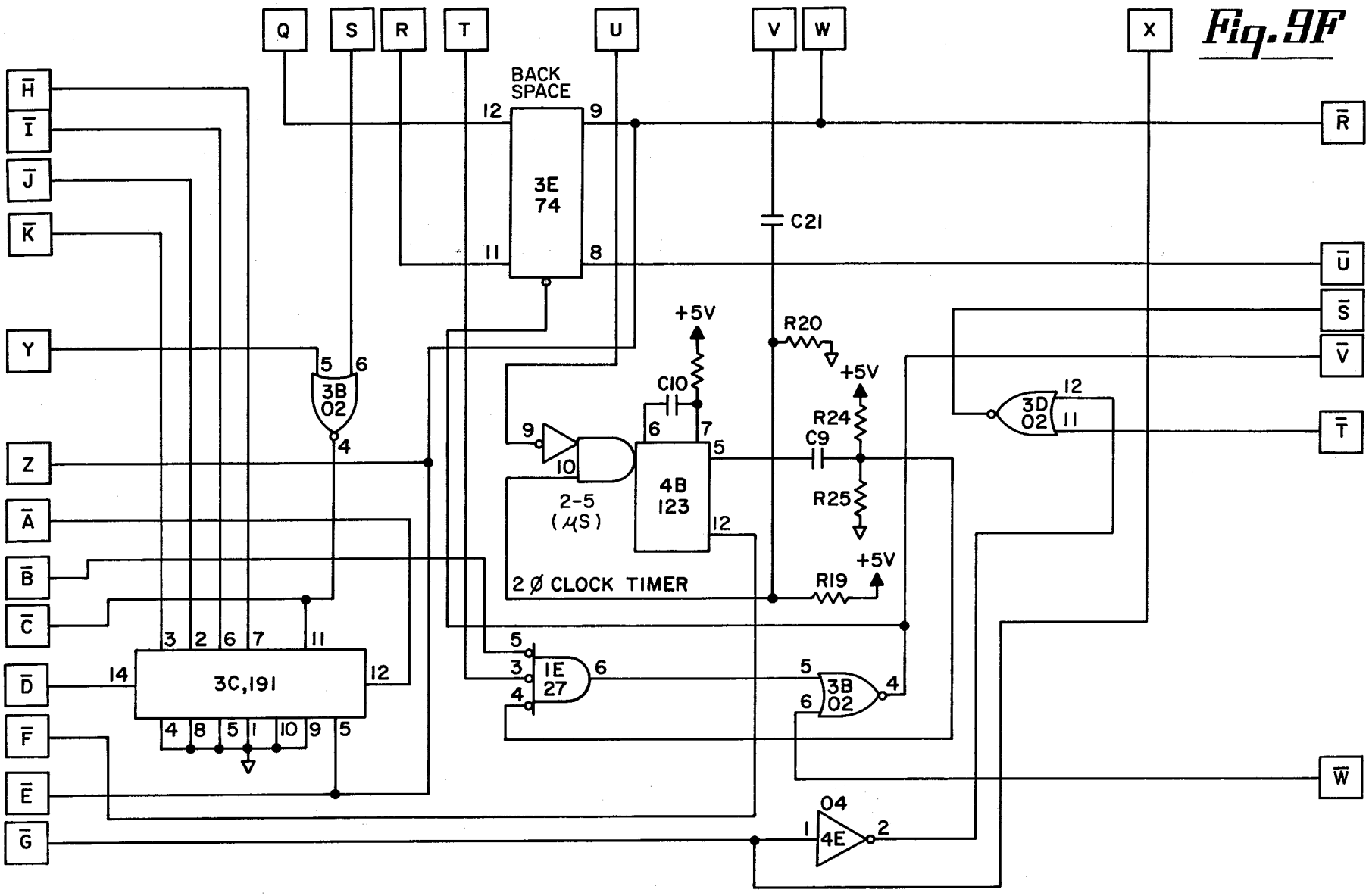

FIG. 9E also discloses a master clear signal which is available from terminal 16 on FIG. 20H of U.S. Pat. No. 3,924,722, the signal appearing whenever the "power on" switch of the keyboard buffer circuits is actuated. A signal appearing on input terminal 11 is applied to carrier return counter 2E-74, line or carrier return flip-flop 3E-74, tab or carrier return flip-flop 2D-74 and print flip-flop 2D-74.

Through the use of the circuits which are shown basically in FIGS. 9A–9F, means are provided for controlling the position of typewriter carriage without the attendant rack and pawl mechanisms and all of their mechanical features connected thereto which require numerous adjustments, all of which are subject to wear thus making them less reliable. A positive control is disclosed which provides means for controlling each of the operational functions requiring a movement of the carriage that avoids mechanical adjustments.

It will, of course, be understood that various changes may be made in the form, details, arrangement and proportions of the parts without departing from the scope of the invention which consists of the matter shown and described herein and set forth in the appended claims.

What is claimed is:

1. Typewriter carriage control mechanism comprising:

a. carriage means carrying a single element print head constructed and arranged for transverse movement with respect to a print receiving medium;

b. first motor means connected to said carriage means providing motive power for movement of said carriage means in a first direction;

c. ratchet wheel means connected to said first motor means and having a predetermined number of teeth formed around the edge thereof;

d. sensor means disposed in ratchet wheel tooth confronting relationship providing signals representative of rotational movement of said ratchet wheel means;

e. pawl means disposed in ratchet wheel tooth engaging relationship producing circumferential displacement of said ratchet wheel means;

f. second motor means operatively connected to, and actuating, said pawl means in discrete movements, said second motor means having first solenoid means operably connected to said pawl means and said first timer means for initiating the movement of said carriage means in said first direction, and having second solenoid means operably connected to said pawl means and said first timer means for arresting the movement of said carriage means in a first direction;

g. electrical control means including power means adapted to receive signals representative of typewriter carriage print and operational function movements;

h. and first timer means connected to said electrical control means, said sensor means and said second motor means, said first timer means being actuated by said signals from said sensor means whereby said second motor means operates to carry out said carriage print and operational functions.

2. The structure set forth in claim 1 including:

i. third motor means connected between said carriage means and said electrical control means providing motive power to said carriage means in a direction opposite said first direction upon receiving a signal from said electrical control means representative of at least one carriage operational function movement.

3. The structure set forth in claim 1 including:

visual sensing means connected to said sensor means providing a visual indication of the polarity and phase of said ratchet wheel with respect to said sensor means.

4. The structure set forth in claim 1 wherein said ratchet wheel means includes:

a first wheel having a first predetermined number of teeth formed around the edge thereof;

a second wheel having a second predetermined number of teeth formed around the edge thereof, the ratio of siad first number of teeth to said second number of teeth being substantially five to six.

5. The structure set forth in claim 1 including:

third solenoid means operably connected to said pawl means and said electrical control means providing single step motive power to said carriage means in a direction opposite said first direction upon receiving a signal from said electrical control means representative of a back space function movement.

6. The structure as set forth in claim 5 wherein said pawl means includes a first pawl mechanism connected to said first and second solenoid means and a second pawl mechanism connected to said third solenoid means.

7. The structure set forth in claim 2 including:

auxiliary counting means connected to said electrical control means for counting consecutive signals representative of a carrier return or line return;

electrical connecting means connecting said auxiliary counting means to said electrical control means and said first timer means whereby said first timer is inhibited for a predetermined period of time.

8. The structure set forth in claim 2 including:

tab operation memory means having a first input for receiving signals representative of a tab position and having an ouput signal representative of said carriage means moving to a tab position;

counting means connected to said tab operation memory means producing output signals representative of carriage movement in said first direction;

second timer means interconnected between said third motor means, said counting means, said sensor means and said electrical control means, said electrical control means providing a signal to said second timer means representative of a tab operational function, said second timer means enabling said counting means and said first timer means upon completion of said tab function, said third motor means being disabled during said tab function by said second timer means.

9. The structure set forth in claim 8 wherein said electrical control means includes:

electronic switch means connected to said counting means and actuated by said signal representative of said back space function movement, said electronic switch means providing a count down signal to said counting means.

10. The structure set forth in claim 8 including:

tab switch means connected to said tab operation memory means, said tab switch means clearing said memory means of a tab position when actuated in a first condition and setting said memory means to a tab position when actuated to a second condition.

11. The structure set forth in claim 8 including:

interlock control circuits connected to said second timer means for receiving signals therefrom;

and interconnecting means connected to the output of said interlock control circuits, said interconnecting means adapted to be connected to a typewriter buffer control means to disable the same when output signals are received from said interlock control circuits.

12. The structure set forth in claim 1 wherein said first timer means includes:

a first timer which expires at the end of a first predetermined time period providing an output signal representative thereof; and a second timer connected to, and actuated by, said first timer output signal, said second timer expiring at the end of a second predetermined time period to provide an output signal representative thereof.

13. In a typewriter carriage control mechanism, the combination comprising:

a. carriage means carrying a single element print head constructed and arranged for transverse movement with respect to a print receiving medium;

b. first motor means connected to said carriage means providing motive power for movement of said carriage means in a first direction;

c. ratchet wheel means connected to said first motor means and having a predetermined number of teeth formed around the edge thereof;

d. analog-to-digital converter means disposed in ratchet wheel tooth confronting relationship providing digital signals representative of circumferential movement of said ratchet wheel means;

e. first electronic switching means adapted to receive signals representative of typewriter carriage operational function movements and provide output signals representative thereof;

f. first gating circuit means connected to said first electronic switching means and said analog-to-digital converter means to receive said output signals therefrom;

g. clock timer means generating clock pulses and being constructed to said first gating circuit means and being gated thereby;

h. counting means for counting up and down connected to the output of said clock timer means;

i. a second gating circuit means connected between the output and input of said counting means to provide a reset signal thereto upon a cessation of output signals from said first gating circuit means.

14. The structure set forth in claim 13 including:

j. second electronic switching means adapted to receive signals representative of at least one typewriter carriage operational function movement for moving said carriage in a second direction;

k. third gating circuit means connected to said second electronic switching means and to said clock timer means to provide a reset signal; l. and means connecting said second electronic switching means to said second and third gating circuit means and to said counting means enabling said counting means.

15. The structure set forth in claim 13 including:

random access memory means connected to said counting means to remember the relative position of said carriage means with respect to said print receiving medium;

memory address means connected to said random-access memory means, said address being representative of said carriage means position;

forth gating circuit means connected to the outputs of said random-access memory means, said clock timer means, said first gating circuit means, said forth gating circuit means having its output connected to said first electronic switching means to preset the same upon cessation of output signals from said first gating circuit means.

16. The structure set forth in claim 15 including:

memory address erasure means connected to said random-access memory means for erasure of an address being representative of said carriage means position.

17. The structure set forth in claim 16 wherein said random-access memory means includes independent voltage means to keep said random-access memory means independent of a supply voltage to said carriage control mechanism and means for charging said independent voltage means when said supply voltage is applied.

18. The structure set forth in claim 2 including:

reset means connected to said electrical control means, and said auxiliary counting means for actuating said electrical control means and said auxiliary counting means to a predetermined condition, said reset means being adapted to receive an input signal representative of said predetermined condition.

* * * * *

UNITED STATES PATENT AND TRADEMARK OFFICE

CERTIFICATE OF CORRECTION

PATENT NO. : 4,067,430

DATED : January 10, 1978

INVENTOR(S) : James L. Wienhold

It is certified that error appears in the above-identified patent and that said Letters Patent are hereby corrected as shown below:

In Column 18, line 39, change "forth" to --fourth--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*